US011673020B1

(12) United States Patent
Graack

(10) Patent No.: US 11,673,020 B1
(45) Date of Patent: Jun. 13, 2023

(54) SQUAT MACHINE

(71) Applicant: Explosive Entities LLC, Goodyear, AZ (US)

(72) Inventor: Wendy Graack, Phoenix, AZ (US)

(73) Assignee: Explosive Entities LLC, Phoenix, AZ (US)

( * ) Notice: Subject to any disclaimer, the term of this patent is extended or adjusted under 35 U.S.C. 154(b) by 105 days.

(21) Appl. No.: 17/060,468

(22) Filed: Oct. 1, 2020

(51) Int. Cl.

| | |
|---|---|
| ***A63B 23/04*** | (2006.01) |
| ***A63B 21/00*** | (2006.01) |
| ***A63B 21/04*** | (2006.01) |
| ***A63B 21/055*** | (2006.01) |

(52) U.S. Cl.
CPC ..... *A63B 23/0405* (2013.01); *A63B 21/0442* (2013.01); *A63B 21/0552* (2013.01); *A63B 21/4009* (2015.10); *A63B 21/4034* (2015.10); *A63B 2023/0411* (2013.01); *A63B 2208/0204* (2013.01); *A63B 2208/0233* (2013.01); *A63B 2225/093* (2013.01)

(58) Field of Classification Search
CPC ..... A63B 23/0405; A63B 21/0442; A63B 21/0552; A63B 21/4009; A63B 21/4034; A63B 2023/0411; A63B 2208/0204; A63B 2208/0233; A63B 2225/093; A63B 1/00; A63B 6/00; A63B 9/00; A63B 21/00047; A63B 21/00058–00065; A63B 21/02–021; A63B 21/04; A63B 21/055; A63B 21/4001; A63B 21/4023; A63B 21/078; A63B 21/4029
See application file for complete search history.

(56) References Cited

U.S. PATENT DOCUMENTS

| | | | | |
|---|---|---|---|---|
| 3,787,048 | A * | 1/1974 | Bock | A63B 21/00047 482/145 |
| 7,780,586 | B2 * | 8/2010 | Gates | A63B 26/00 482/142 |
| 8,597,165 | B1 * | 12/2013 | Antonucci | A63B 21/4047 482/130 |
| 9,630,055 | B2 * | 4/2017 | Runyan | A63B 21/00047 |
| 10,456,620 | B1 * | 10/2019 | Duenas | A63B 21/4011 |
| 11,077,338 | B1 * | 8/2021 | Levin | A63B 21/4034 |
| 2008/0199839 | A1 * | 8/2008 | Fugitt | A63B 21/4015 434/247 |
| 2018/0311529 | A1 * | 11/2018 | Sadikaj | A63B 69/0062 |
| 2019/0209890 | A1 * | 7/2019 | Moreno | A63B 21/4035 |
| 2020/0094099 | A1 * | 3/2020 | Kelly | A63B 21/0609 |

* cited by examiner

*Primary Examiner* — Joshua Lee
*Assistant Examiner* — Catrina A Letterman
(74) *Attorney, Agent, or Firm* — IPTechLaw

(57) ABSTRACT

Implementations of squat machines may include a seat coupled to a platform, a first foot brace directly coupled to the platform, a second foot brace directly coupled to the platform, a knee brace post coupled to and extending perpendicularly away from a first surface of the platform, a knee brace arm directly coupled to the knee brace post and extending perpendicularly away from a longest length of the knee brace post, and a knee brace directly coupled to the knee brace arm. The knee brace may be configured to contact the front of either a user's knees or shins while performing a squat exercise. The seat may be configured to temporarily contact a buttocks of a user while performing the squat exercise.

9 Claims, 9 Drawing Sheets

SQUAT MACHINE

BACKGROUND

1. Technical Field

Aspects of this document relate generally to exercise equipment. More specific implementations involve squat machines.

2. Background

A squat exercise is done by lowering the hips from a standing position and flexing the hip and knee joints. Squat exercises are done to increase leg strength. Squat exercises can be performed either with or without additional weight placed on the individual performing the exercise.

SUMMARY

Implementations of squat machines may include a seat coupled to a platform, a first foot brace directly coupled to the platform, a second foot brace directly coupled to the platform, a knee brace post coupled to and extending perpendicularly away from a first surface of the platform, a knee brace arm directly coupled to the knee brace post and extending perpendicularly away from a longest length of the knee brace post, and a knee brace directly coupled to the knee brace arm. The knee brace may be configured to contact the front of either a user's knees or shins while performing a squat exercise. The seat may be configured to temporarily contact a buttocks of a user while performing the squat exercise.

Implementations of squat machines may include one, all, or any of the following:

Implementations of squat machines may include a telescoping seat post which may be configured to adjust the height of the seat.

Implementations of squat machines may include a first foot restraint coupled to the first foot brace and a second foot restraint coupled to the second foot brace. The first foot brace and the second foot brace may be configured to prevent forward movement of a user's feet while performing a squat exercise and the first foot restraint and the second foot restraint may be configured to prevent rearward movement of the user's feet while performing a squat exercise.

A distance between the knee brace and the platform may be adjustable.

A distance between the knee brace and the seat may be adjustable through either an adjustment of the knee brace, an adjustment of the seat, or an adjustment of the knee brace and the seat.

Implementations of squat machines may be configured to keep an angle between a front of the user's shins and a portion of the platform between a front of the squat machine and the user's shins at either 90 degrees or above 90 degrees through an entire motion of the squat exercise.

Implementations of squat machines may include a seat coupled to a platform, a first foot brace directly coupled to the platform, a second foot brace directly coupled to the platform, and a knee brace coupled to the platform. The knee brace may be configured to contact the front of either a user's knees or shins while performing a squat exercise. Implementations of the squat machine may also include a first resistance attachment mechanism coupled to the platform, a second resistance attachment mechanism coupled to the platform, a first resistance band configured to couple between a user and the first resistance attachment mechanism while the user performs a squat exercise, and a second resistance band configured to couple between the user and the second resistance attachment mechanism while the user performs a squat exercise. The seat may be configured to temporarily contact a buttocks of a user while performing the squat exercise.

Implementations of squat machines may include one, all, or any of the following:

A position of the first resistance attachment mechanism relative to the platform and a position of the second resistance attachment mechanism relative to the platform may be adjustable.

Implementations of squat machines may be configured to keep an angle between a front of the user's shins and a portion of the platform between a front of the squat machine and the user's shins at one of 90 degrees or above 90 degrees through an entire motion of the squat exercise.

Implementations of squat machines may include either a belt or a chest harness configured to couple to the first resistance band and the second resistance band.

Implementations of squat machines may include a first foot restraint coupled to the first foot brace and a second foot restraint coupled to the second foot brace. The first foot brace and the second foot brace may be configured to prevent forward movement of a user's feet while performing a squat exercise and the first foot restraint and the second foot restraint may be configured to prevent rearward movement of the user's feet while performing a squat exercise.

Implementations of squat machines may include a platform having a first track and a second track. Implementations of squat machines may also include a seat coupled to the platform. The platform may be configured to have a user stand on a first surface thereof while performing a squat exercise. Implementations of squat machines may also include a first foot brace directly coupled to the platform, a first foot restraint coupled to the first foot brace, a second foot brace directly coupled to the platform, a second foot restraint coupled to the second foot brace, a knee brace post coupled to and extending perpendicularly away from the first surface of the platform, a knee brace arm directly coupled to the knee brace post and extending perpendicularly away from the longest length of the knee brace post, a knee brace directly coupled to the knee brace arm, the knee brace configured to contact the front of one of a user's knees or shins while performing a squat exercise, a first resistance attachment mechanism slidably coupled within the first track, a second resistance attachment mechanism slidably coupled within the second track, a belt configured to be worn by the user while performing the squat exercise, and a plurality of resistance bands configured to couple to the belt and to the first resistance attachment mechanism and the second resistance attachment mechanism. The seat may be configured to temporarily contact a buttocks of a user while performing the squat exercise.

Implementations of squat machines may include one, all, or any of the following:

The first resistance attachment mechanism and the second attachment mechanism may be configured to slide in a direction parallel to a longest length of the squat machine.

Implementations of squat machines may include a third track included in the platform, a third resistance mechanism slidably coupled within the third track, and a fourth resistance mechanism slidably coupled within the third track. The third track may be perpendicular to the first track and the second track.

Implementations of squat machines may include a third track included in the platform, a fourth track included in the platform, a third resistance attachment mechanism slidably coupled within the third track, and a fourth resistance attachment mechanism slidably coupled within the fourth track. The third track and the fourth track may be parallel to the first track and the second track.

Implementations of squat machines may include a seat post track included within a center of the platform. The seat post track may extend parallel to a longest length of the squat machine. Implementations of squat machines may also include a seat post slidably coupled within the seat post track and directly coupled to the seat.

The first foot brace may include a first pillar extending perpendicularly away from the platform. The second foot brace may include a second pillar extending perpendicularly away from the platform.

A first distance parallel to the platform between the knee brace and a rear of the squat machine may be less than a second distance parallel to the platform between the first foot brace and the rear of the squat machine.

The squat machine may be configured to keep the user's shins in a position substantially perpendicular to the platform when the user is in a squat position.

The knee brace may include a first knee brace pad and a second knee brace pad.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended squat machine will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such squat machines, and implementing components and methods, consistent with the intended operation and methods.

Figure 1:
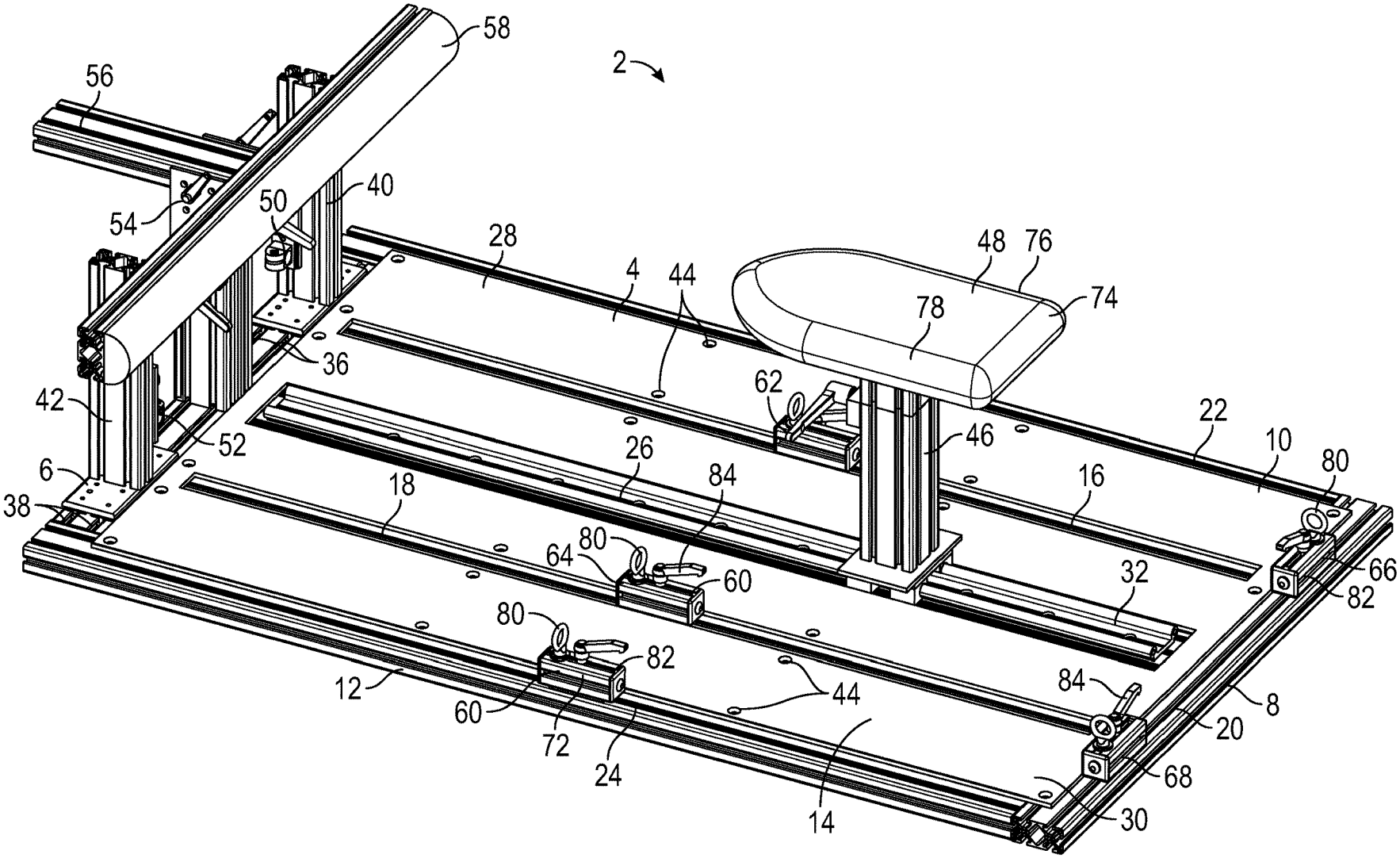
FIG. 1 is a perspective view of a squat machine.
Figure 2:
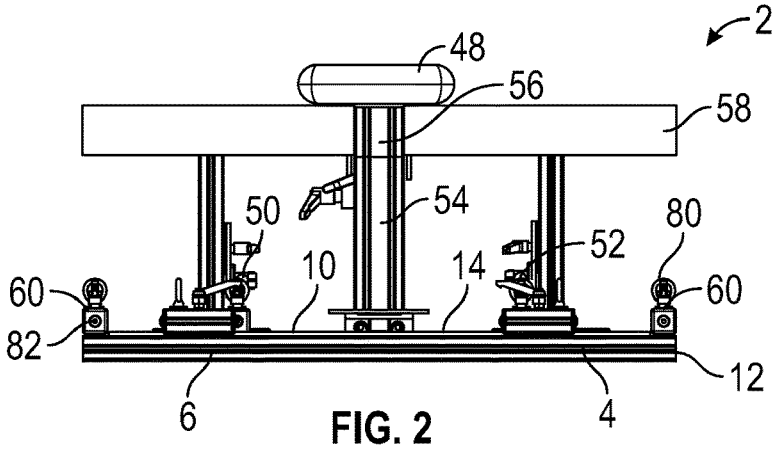
FIG. 2 is a front view of the squat machine of FIG. 1.
Figure 3:
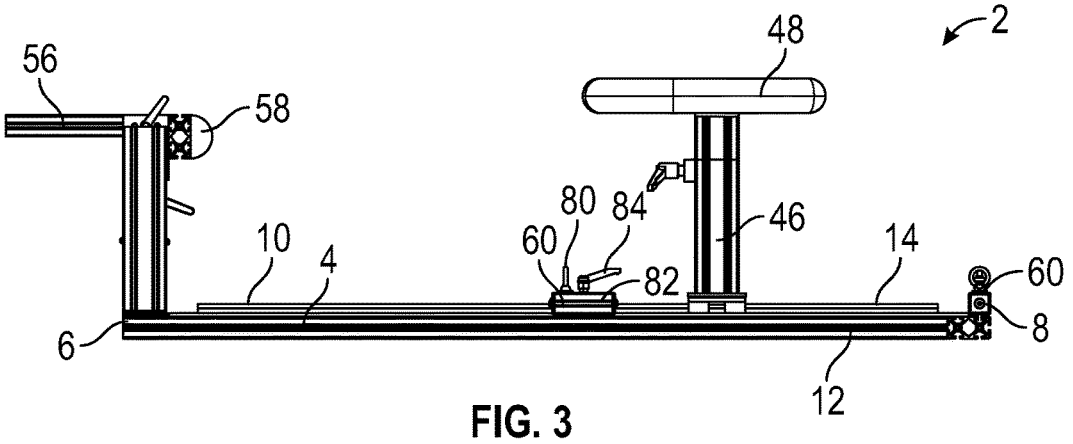
FIG. 3 is a side view of the squat machine of FIG. 1.
Figure 4:
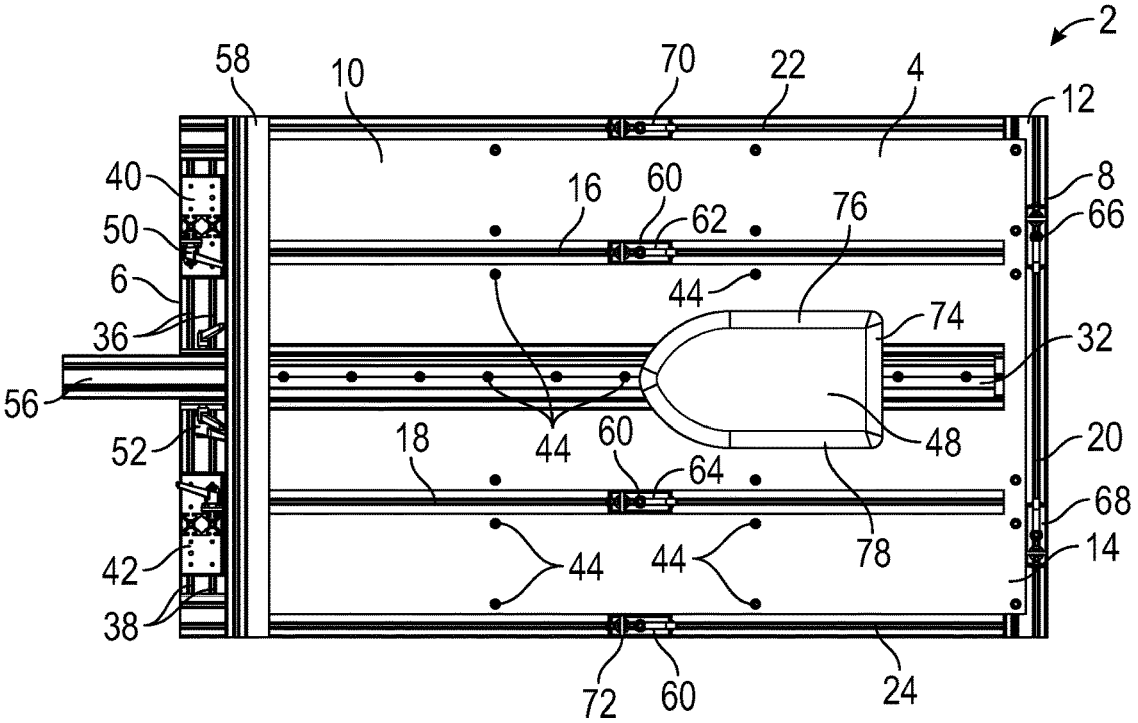
FIG. 4 is a top view of the squat machine of FIG. 1.

Referring to FIG. 1, a perspective view of a first implementation of a squat machine is illustrated. Referring to FIG. 2, a front view of the squat machine of FIG. 1 is illustrated. Referring to FIG. 3, a side view of the squat machine of FIG. 1 is illustrated. Referring to FIG. 4, a top view of the squat machine of FIG. 1 is illustrated. As illustrated by FIGS. 1-4, the squat machine 2 includes a front side 6 and a rear side 8 opposite the front side. As used herein, the front side 6 refers to the side a user faces when performing a squat exercise on the squat machine and the rear side 8 refers to the side of the squat machine a user's back faces when performing a squat exercise on the squat machine 2. In various implementations, the squat machine 2 includes a platform 4. The platform 4 may be made from a metallic material, a polymer, a composite material, or any other rigid material capable of supporting a user while performing a squat exercise. The platform 4 may include a first surface 10. As illustrated by FIGS. 1 and 4, the first surface 10 may include a rectangular perimeter. In particular implementations the rectangular perimeter may include a longest length of six feet and a width of five feet. In other implementations the length and/or width of the perimeter of the platform (and in turn, the perimeter of the squat machine) may be greater than or less than six feet by five feet. In other implementations, the first surface 10 may include a non-rectangular perimeter. The platform 4 may be configured to have a user stand on the first surface 10 while performing a squat exercise on the squat machine. In such implementations, the platform 4 may include markings on the first surface 10 indicating where a user should place their feet. In other implementations, the squat machine may not be configured to have a user stand thereon while performing a squat exercise, but rather the user may be configured to stand directly on the ground while performing the squat exercise. In such implementations, the platform 4 may support the seat and the knee brace as disclosed herein but not extend to the area where a user plants their feet when performing a squat exercise. In particular implementations, and as illustrated by FIGS. 1-4, the platform may include a base portion 12 and a deck 14 coupled over the base portion 12. In such implementations, the user may be configured to stand on the deck 14 when performing the squat exercise. In other implementations the platform 4 may include the deck without any base.

As illustrated by FIGS. 1 and 4, the platform may include one or more tracks formed therein. In particular implementations the platform may include any or all of a first track 16, a second track 18, a third track 20, a fourth track 22, and/or a fifth track 24. As illustrated by FIGS. 1 and 4, the first track 16, the second track 18, the fourth track 22, and the fifth track 24 may all be parallel to one another. In such implementations, these tracks may run along the longest length of the squat machine 2 and platform 4. In various implementations, the third track 20 may be perpendicular to the first track 16, second track 18, fourth track 22, and fifth track 24. The third track 20 may be adjacent to the rear side 8 of the squat machine and may run perpendicular to the longest length of the squat machine 2 and platform 4. In other implementations, though not illustrated, the platform may include fewer tracks or more tracks configured to receive resistance attachment mechanisms than what is illustrated by FIGS. 1 and 4. In particular other implementations, rather than having the third track 20 continuously extend across the width of the platform, the platform may include two tracks separated by a barrier in the center 26 of the platform 4 in place of the third track.

While the first track 16, second track 18, fourth track 22, and fifth track 24 are illustrated as parallel to one another, in other implementations these tracks may not be parallel to one another. While these tracks are illustrated as spanning nearly the longest length of the platform 4, in other implementations any or all of these tracks may extend across only the front half 28 of the platform, the rear half 30 of the platform, or in any other area of the platform.

In various implementations the fourth track 22 and the fifth track 24 may run adjacent to the two opposing sides of the platform 4 between the front side 6 and the rear side 8 of the squat machine 2. In particular implementations the first track 16 may be between 4-6 inches from the fourth track 22 and the second track 18 may be 4-6 inches from the fifth track 24. The first track 16 and the second track 18 may be 4-6 inches from the center 26 of the squat platform 4. In other implementations these tracks may be spaced more or less than 4-6 inches from any other track and/or from the center 26 of the platform 4.

In implementations where the platform includes a base portion 12 and a deck 14, the tracks may be included within the base portion. In such implementations, the deck 14 may not cover some or all of the tracks (as illustrated by the third, fourth and fifth track of FIGS. 1 and 4) or may have openings formed therein exposing some or all of the tracks (as illustrated by the first and second track of FIGS. 1 and 4).

Still referring to FIGS. 1 and 4, the platform 4 may include a seat post track 32. The seat post track may be included within the center 26 of the platform 4 and may extend parallel to the longest length of the squat machine. The seat post track 32 may extend along half of the length of the platform 4, more than half of the length of the platform, or less than half of the length of the platform. In other implementations, the platform 4 may not include a seat post track 32. In such implementations, the seat post may still be coupled to the platform 4.

In various implementations the platform may include one or more first foot brace tracks 36 and one or more second foot brace tracks 38 configured to receive a first foot brace 40 and a second foot brace 42.

In various implementations the platform may include a plurality of locking openings 44 therein. The plurality of locking openings 44 may be configured to receive a pin and lock the seat post 46 or any resistance attachment mechanisms in place within a corresponding track.

Referring to FIGS. 1 and 3, the squat machine 2 includes a seat post 46. The seat post 46 may be slidably coupled to the seat post track 32. As used herein, "slidably" means the ability to slide. In such implementations, the position of the seat post may be adjusted towards the front side 6 of the squat machine or towards the rear side 8 of the squat machine. In other implementations, the seat post 46 may be adjustably coupled to the platform 4 but not slidably coupled to the platform. In still other implementations, the seat post 46 may be non-adjustably coupled to the platform 4.

In various implementations where the seat post is adjustable, the seat post may be configured to temporarily lock in place through a locking mechanism to allow a user to perform a squat exercise without the seat post moving.

In various implementations the seat post 46 may be configured to telescope. In such implementations, the height of the seat post 46 may be adjustable and result in the height of a seat 48 coupled to the seat post also being adjustable. In implementations having a telescoping seat post, the seat post 46 may also include a locking mechanism configured to secure the height of the seat post to prevent the height of the seat 48 from adjusting while a user performs a squat exercise on the squat machine. The locking mechanism may be similar to or the same as the locking mechanism 114 of FIG. 5.

The squat machine may include a seat 48 coupled to the seat post 46. The seat may be configured to temporarily contact the buttocks of a user while performing the squat exercise. In various implementations the seat post may be directly coupled to the seat. The position of the seat 48 between the front side 6 and the rear side 8 of the squat machine 2 may be adjustable. In particular implementations, the position of the seat 48 between the front side 6 and the rear side 8 may be adjustable through the adjustability of the seat post 46 coupled to the platform. In other implementations the position of the seat 48 relative between the front side 6 and the rear side 8 of the squat machine relative to the seat post may be adjustable. In such implementations, the seat 48 may be adjustably coupled to the seat post 46 and may be configured to lock in place via a locking mechanism, such as, by non-limiting example, a pin, included in either the seat or the seat post.

Still referring to FIGS. 1-2 and 4, the squat machine 2 may include a first foot brace 40 and a second foot brace 42 coupled to the platform 4. In particular implementations, the first foot brace 40 and the second foot brace 42 may be directly coupled to the platform 4. The first foot brace 40 and the second foot brace may be configured to prevent the feet of a user performing a squat exercise from moving forward (towards the front side 6 of the squat machine) while the user performs the squat exercise. In various implementations the first foot brace and the second foot brace are each a pillar extending perpendicularly away from the platform 4. In such implementations, the first foot brace 40 and the second foot brace 42 may be adjustably coupled to the platform 4 and configured to be positioned at various points along a width perpendicular to the longest length of the squat machine. Through the foot braces being adjustable, it may accommodate both users that squat with a wide or narrow stance. In implementations where the foot braces are adjustable, the foot braces may be temporarily secured in place through one or more locking mechanisms. In implementations where the platform 4 includes one or more first foot brace tracks 36 and one or more second foot brace tracks 38, the first foot brace 40 may be slidably coupled within the one or more first foot brace tracks 36 and the second foot brace 42 may be slidably coupled within the one or more second foot brace tracks 38.

In other implementations the first foot brace and the second foot brace may include a bar directly and fixedly coupled to the platform and having a width sufficiently wide to allow a user to adjust the positioning of their feet from a wider stance to a more narrow stance (and vice versa) and have the fixed bar prevent forward movement of the user's feet. Such an example is illustrated by the implementation of the squat machine in FIGS. 5-8. In various implementations the first foot brace and the second foot brace together may extend an entire width of the squat machine, while in other implementations the first foot brace and the second foot brace together may not span the entire width of the squat machine.

In other implementations the squat machine may not include a first foot brace and a second foot brace. In such implementations a user may rely upon the friction between the bottom of their footwear and either the platform or the ground to prevent forward movement of the user's feet while performing the squat exercise.

In various implementations the squat machine 2 may include a first foot restraint 50 coupled to the first foot brace 40 and a second foot restraint 52 coupled to the second foot brace 42. The foot restraints may be directly coupled to the foot braces. The first foot restraint 50 and the second foot restraint 52 are configured to prevent rearward movement (or movement towards the rear side 8 of the squat machine) of the user's feet while performing a squat exercise. In various implementations the first foot restraint 50 and the second foot restraint 52 may also be configured to restrict side-to-side movement of the user's feet while performing a squat exercise.

In implementations where the first foot brace 40 is a first pillar and the second foot brace 42 is a second pillar, the first foot restraint 50 may be adjustably coupled to the first foot brace along a height of the pillar and the second foot restraint 52 may be adjustably coupled to the second foot brace along a height of the pillar in a manner that allows for a height of the foot restraints, or a distance between the foot restraints and the platform, to be adjustable. In such implementations the foot restraint may be adjusted to fit around the back of various users calves or ankles. In various implementations, each of the foot restraints may include an arm coupled to the first foot brace and the second foot brace and configured to pivot from a storage position to an in use position. In such implementations, when the foot restraints are in a storage position the arms may lie flush against the pillars in a direction parallel to the longest length (or height) of the pillars. When the foot restraints are in an "in use" position, the arms may be pivoted to a position extending perpendicularly away from the longest length of the pillar foot braces and pointed towards the rear side 8 of the squat machine 2. In various implementations, a strap may be configured to couple to an end of the arm, wrap around a user's calf or ankle, and reattach to the pillar. In other implementations a bar may extend from an end of the arm of the foot restraint and be configured to extend behind a user's calf or ankle, thereby preventing rearward movement of the user's feet when performing a squat exercise on the squat machine 2. In implementations having a strap extend around the user's calf or ankle, the side-to-side movement of the user's feet may also be prevented.

In implementations where a foot restraint includes a strap, the strap may be configured to secure a user's foot through hooks, snaps, hook and loop fasteners, clips, buckles, ties, or any other fastening mechanism.

In other implementations the first foot restraint and the second foot restraint may each include a mold configured to receive a foot. In such implementations the sidewalls of the molds may prevent rear-ward and side-to-side movement of the user's feet when performing a squat exercise.

In other implementations the squat machine may not include a first foot restraint and a second foot restraint. In such implementations friction between the bottom of the user's shoe and the platform or ground may be sufficient to prevent the user's feet from moving while performing the squat exercise on the squat machine.

Referring to FIGS. 1-2, the squat machine may include a knee brace post 54. The knee brace post 54 may be coupled to and extend perpendicularly away from the first surface 10 of the platform 4. In various implementations the height of the knee brace post 54 may be adjustable. In such implementations, the knee brace post 54 may be configured to telescope. In various implementations the knee brace post 54 may be adjustably coupled to the platform 4. In such implementations, the knee brace post 54 may be configured to adjustably couple to the platform 4 closer to or further from the front side 6 of the squat machine 2. In particular implementations, the knee brace post 54 may be slidably coupled to the platform 4. In implementations where the knee brace post 54 is adjustable, the squat machine 2 may include a locking mechanism configured to secure the position of the knee brace post 54. The locking mechanism may be any type of locking mechanism disclosed herein. In other implementations, the first foot brace 40 and the second foot brace 42 may also be considered a first and second knee brace post. In such implementations, the squat machine may not include a knee brace post between the first foot brace 40 and the second foot brace 42 but the knee brace arm 56 may couple to the first and second foot braces in a similar manner as the knee brace post 54 couples to the knee brace arm 56.

Referring to FIGS. 1-4, the squat machine 2 may include a knee brace arm 56 directly coupled to the knee brace post 54. In various implementations, the knee brace arm 56 may extend perpendicularly away from a longest length of the knee brace post 54. The knee brace arm 56 may be adjustably coupled to the kneed brace post 54. In such implementations the knee brace arm 56 may be configured to adjustably extend away from or towards the knee brace post 54. In various implementations, the knee brace arm 56 may also be configured to adjust the distance between the knee brace arm 56 and the platform 4 by adjustably and directly coupling to the knee brace post 54 at different heights along the knee brace post. In various implementations, the knee brace post 54 may include one of an opening or a channel configured to receive the knee brace arm 56. In such implementations, the opening or channel of the knee brace post may be configured to allow the knee brace arm 56 to adjustably slide within the channel or opening. In implementations where the knee brace arm 56 is adjustably coupled to the knee brace post 54, the squat machine 2 may include a locking mechanism configured to secure the knee brace arm 56 to the knee brace post 54. The locking mechanism may be any type of locking mechanism disclosed herein. In other implementations, the knee brace arm 56 may be non-adjustably coupled to the knee brace post 54. In still other implementations, the squat machine 2 does not include a knee brace arm 56.

Still referring to FIGS. 1-4, the squat machine includes a knee brace 58. The knee brace 58 may be directly coupled to the knee brace arm 56. In implementations not having a knee brace arm, the knee brace 58 may be directly coupled to the knee brace post 54. The knee brace 58 is configured to contact the front of either a user's knees or shins while performing a squat exercise and may be configured to prevent the user from bending their knees forward beyond the knee brace 58 while performing the squat exercise. In particular implementations, the knee brace 58 may be configured to contact the front of the user's leg substantially one inch below the user's knee cap when the user performs a squat exercise on the squat machine 2.

In various implementations, the knee brace 58 may be adjustable relative to the platform in order to accommodate various heights of users. The knee brace 58 may be configured to adjust closer or further from the front side 6 and rear side 8 of the squat machine 2 and/or may be configured to adjust closer or further from the platform 4. The knee brace may be adjustable through the adjustability of the knee brace post 54, the knee brace arm 56, and/or the knee brace itself.

In various implementations the knee brace 58 may include a bar spanning a width of the squat machine 2. In other implementations, the knee brace 58 may not span the entire width of the squat machine, but may span at least a width of the distance of a user's knees when performing a squat exercise. In various implementations, the knee brace 58 may include a knee brace pad 60 configured to contact the user's shin or knee when performing the squat exercise. In other implementations, the knee brace 58 may include a first knee brace pad and a second knee brace pad as illustrated by the implementation of the squat machine of FIGS. 5-7.

In various implementations, a first distance parallel to the platform between the knee brace 58 and a rear side 8 of the squat machine 2 is less than a second distance parallel to the platform 4 between the first foot brace 40 or the second foot brace 42 and the rear side 8 of the squat machine 2. In such implementations, the knee brace may ensure that an angle between the front of the user's shin and the portion of the platform between the front side of 6 of the squat machine and the user's shins is either 90 degrees or greater than 90 degrees.

Still referring to FIGS. 1-4, the squat machine 2 includes one or more resistance attachment mechanisms 60. In various implementations, and as illustrated by FIGS. 1-4, the squat machine 2 may include a first resistance attachment mechanism 62, a second resistance attachment mechanism 64, a third resistance attachment mechanism 66, a fourth resistance attachment mechanism 68, a fifth resistance attachment mechanism 70, and a sixth resistance attachment mechanism 72. In particular implementations the first resistance attachment mechanism 62 may be slidably coupled within the first track 16, the second resistance attachment mechanism 64 may be slidably coupled within the second track 18, the third resistance attachment mechanism 66 and fourth resistance attachment mechanism 68 may be slidably coupled within the third track 20, the fifth resistance attachment mechanism 70 may be slidably coupled within the fourth track 22, and the sixth resistance attachment mechanism 72 may be slidably coupled within the fifth track 24. In such implementations the first resistance attachment mechanism 62, the second resistance attachment mechanism 64, the fifth resistance attachment mechanism 70, and the sixth resistance attachment mechanism 72 may be configured to slide in a direction parallel to a longest length of the squat machine 2. In such implementations, the third resistance attachment mechanism 66 and the fourth resistance attachment mechanism 68 may be configured to slide in a direction perpendicular to the longest length of the squat machine 2. In other implementations, the one or more resistance attachment mechanisms 60 may be adjustably coupled to the platform but not slidably coupled within a plurality of tracks within the platform 4. In still other implementations, the one or more resistance attachment mechanisms 60 may be non-adjustably coupled to the platform 4. While FIGS. 1-6 are illustrated as having six separate resistance attachment mechanisms, other implementations may include 0, 1, 2, 3, 4, 5, 7, 8, 9, 10, or more than 10 separate resistance attachment mechanisms. Further, in implementations including one or more tracks within the platform, each or any of the one or more tracks may include more than a single resistance attachment mechanism. Further, while FIGS. 1-4 illustrate all of the resistance attachment mechanisms located at particular locations within the tracks, other implementations may include the one or more resistance attachment mechanisms located at any positions along the platform. In still other implementations, the squat machine 2 may include resistance attachment mechanisms directly coupled to the rear side 74 of the seat 48, the first side 76 of the seat, or an opposing second side 78 of the seat.

In various implementations, and as illustrated by FIGS. 1-4, the one or more resistance attachment mechanisms 60 may include a ring 80. In various implementations, the ring 80 may be directly coupled to a block 82. In such implementations, the block 82 may be slidably coupled within a track of the plurality of tracks. In various implementations, the one or more resistance attachment mechanisms 60 may each include a locking mechanism 84. In various implementations, and as illustrated by FIGS. 1-4, the locking mechanism 84 may include a lever configured to lock and unlock the position of the one or more resistance attachment mechanisms 60 within a one or more tracks. In other implementations, the locking mechanism may include a pin.

In other implementations (as illustrated by FIGS. 5-8), the ring may be directly coupled to the platform. In such implementations, the ring may be adjustably or non-adjustably coupled to the platform.

In implementations having one or more resistance attachment mechanisms 60, the resistance coupled to the user during the squat exercise may be customized to work a variety of different muscles based upon the one or more resistance attachment mechanisms ability to be moved.

In various implementations, the squat machine may include one or more resistance bands configured to couple between the one or more resistance attachment mechanisms and a user. The resistance bands may be elastic and may have a clip coupled to the band and configured to clip into the any of the one or more resistance attachment mechanisms 60. The one or more resistance bands may be looped or in sheet form (not looped). In various implementations the resistance bands may be large enough to stretch between the one or more resistance attachment mechanisms 60 and a user's waist, back, or shoulders when the user is in a standing position while performing a squat exercise. In particular implementations each or any of the one or more resistance bands may have a non-stretched length of 12.5 inches, 14.5 inches, less than 12.5 inches, more than 14.5 inches, or between 12.5 inches and 14.5 inches. Each or any of the one or more resistance bands may include a resistance between 35-80 pounds. In other implementations, each or any of the resistance bands may include a resistance less than 35 pounds or more than 80 pounds. In particular implementations, the squat machine may include no more resistance bands than a first resistance band configured to couple between the user and the first resistance attachment mechanism while the user performs a squat exercise. In other implementations, the squat machine may include no more resistance bands than a first resistance band coupled between the user and the first resistance attachment mechanism and a second resistance band coupled between the user and a second resistance attachment mechanism when the user performs a squat exercise. In still other implementations, more than two resistance attachment mechanisms may be coupled between the user and the one or more resistance attachment mechanisms. The resistance bands may be coupled to the same or different resistance attachment mechanisms.

Figure 9:
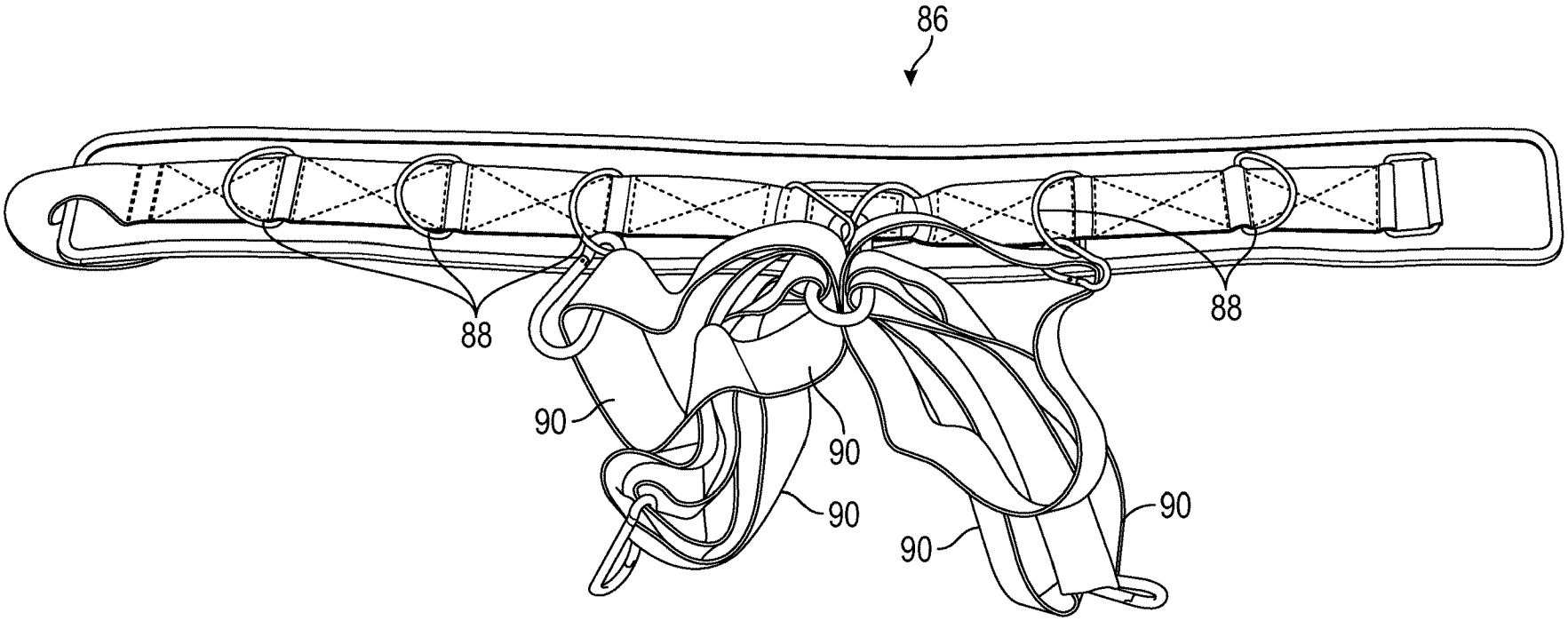
FIG. 9 is a view of a belt.

In implementations including one or more resistance bands, the squat machine may include either a chest harness or a belt configured to couple to the one or more resistance bands. Referring to FIG. 9, a view of a belt is illustrated. As illustrated, the belt 86 may include one or more attachment rings 88 dispersed along a length of the belt 86 and configured to couple to one or more resistance bands 90. In particular implementations, the belt 86 may include between 4-6 attachment rings 88. In other implementations, the belt 86 may include more than six attachment rings or fewer than four attachment rings. The one or more resistance bands may be coupled to one or more clips 92 which may be configured to directly clip into the one or more attachment rings 88 and the one or more resistance attachment mechanisms 60 (see FIGS. 1-4). In particular implementations, and as illustrated, any of the one or more resistance bands 90 may include multiple clips configured to attach to multiple attachment rings in order to increase resistance to the user and/or alter the direction of resistance felt by the user when performing a squat exercise.

The belt may include a buckle, hook and loop fasteners, snaps, a tie, or any other fastening mechanism to secure the belt around the waist of a user.

In other implementations, though not illustrated, the squat machine 2 may include a chest harness. The chest harness may include one or more attachment rings on the back and the one or more resistance bands may be configured to couple to the one or more attachment rings. In such implementations the resistance may be attached to the user's mid or upper back when performing the squat exercise. In such implementations, the resistance may straighten the user's back and promote improved posture during the squat exercise.

In still other implementations, the one or more resistance bands may be configured to loop around a user's shoulders while the user performs the squat exercise without the use of a chest harness.

In various implementations the squat machine may include both the belt and the chest harness. In such implementations the user may be able to alternate between using the belt and the chest harness. Further, in various implementations the squat machine may include a variety of different bands having different resistances and/or lengths. In particular implementations, the squat machine may include 2-3 resistance bands. In such implementations the user may be able to adjust the amount of resistance, where the resistance attaches to the user, and/or the location the resistance attaches to the resistance attachment mechanisms. In such implementations the squat machine may be configured to uniquely customize the amount and direction of resistance for a user's particular needs.

In other implementations, the squat machine may not include elastic resistance bands but may include resistance bands including cables coupled to weight stacks. In such implementations, the one or more resistance attachment mechanisms may include pulleys through which the cables run. The user may then pull the cable upwards when performing the squat exercise and lift a stack of weights. In such implementations, the amount of weight within the stack of weights may be adjustable.

Figure 5:
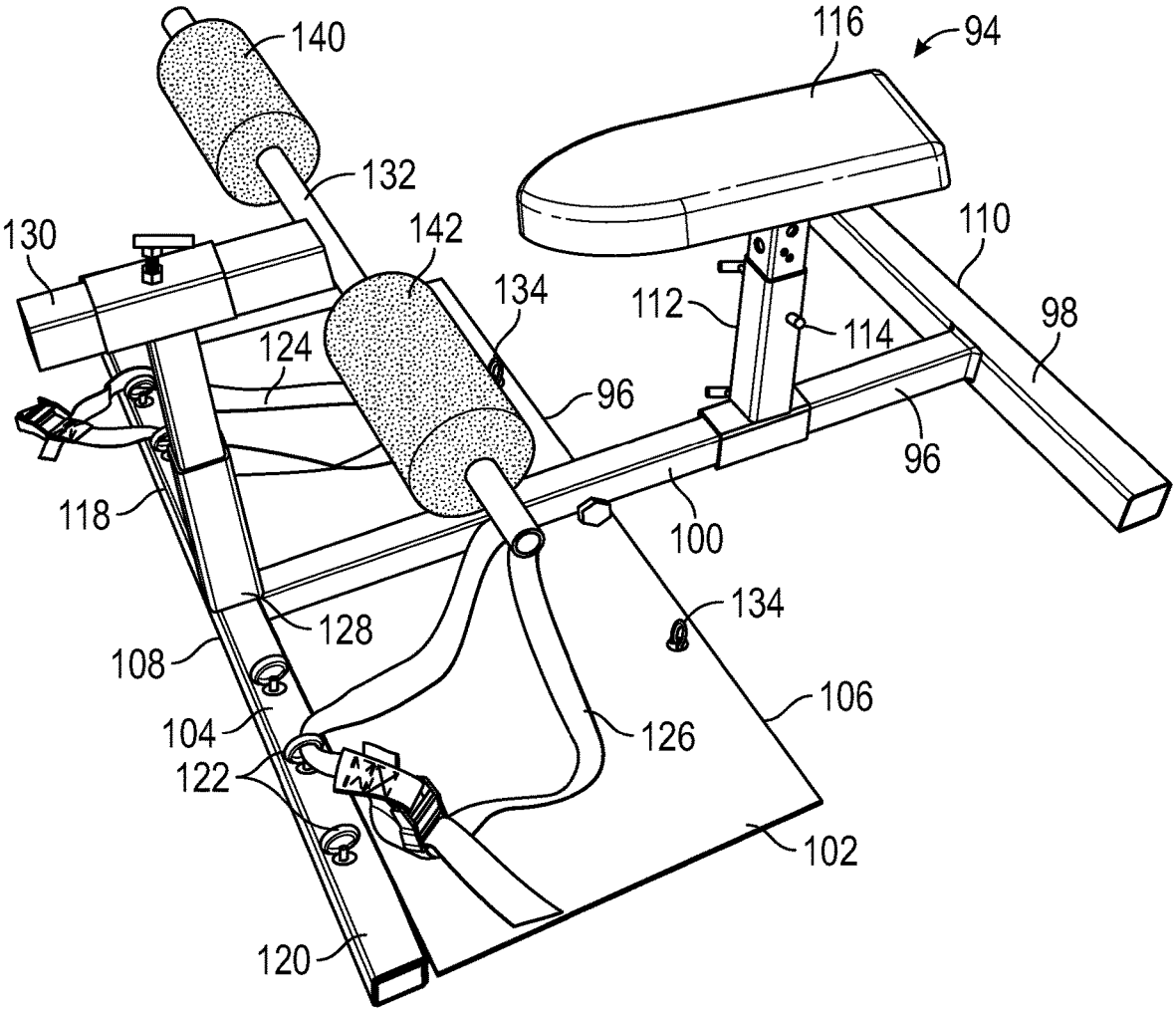
FIG. 5 is a perspective view of a second implementation of a squat machine.
Figure 6:
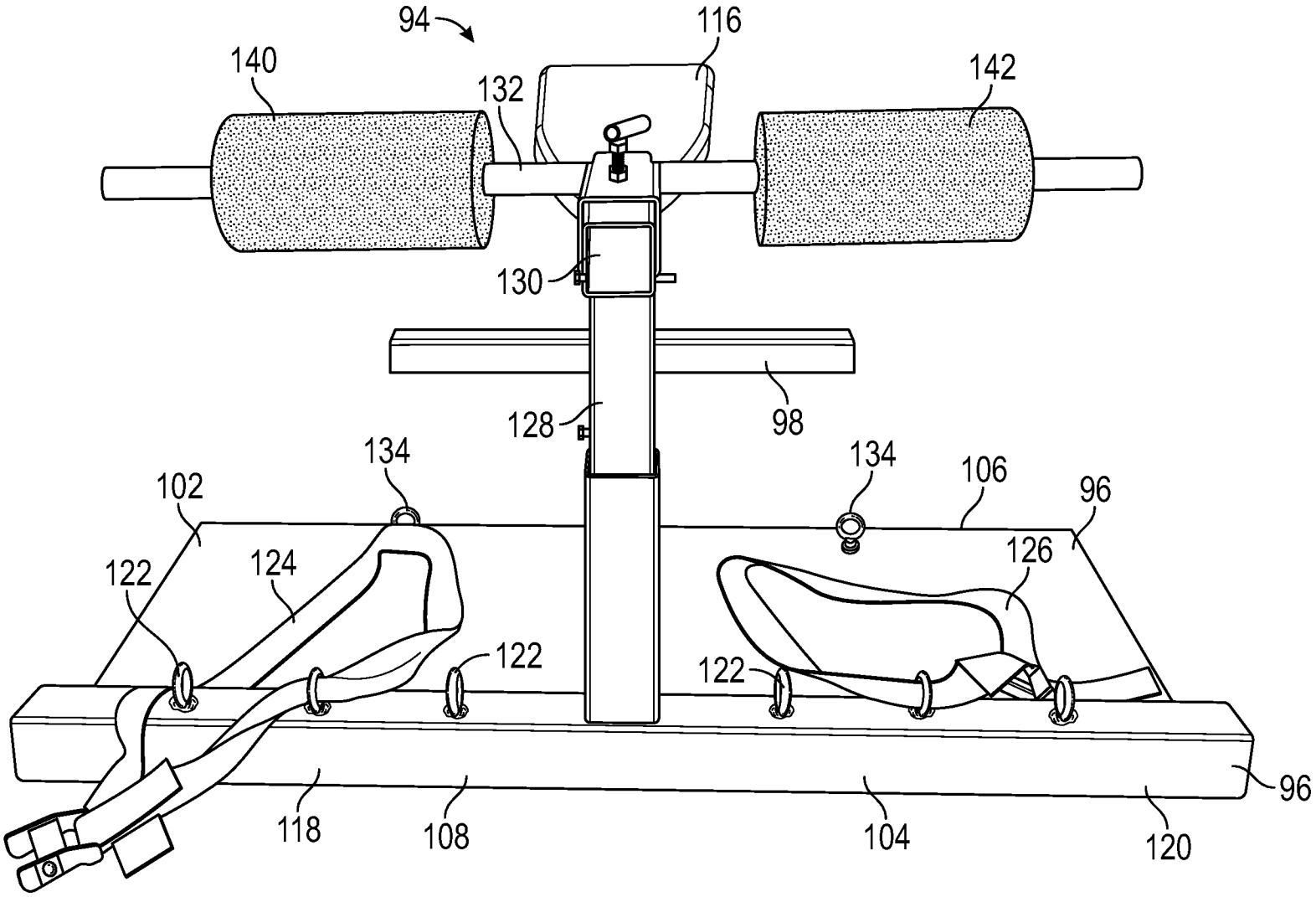
FIG. 6 is a front view of the squat machine of FIG. 5.
Figure 7:
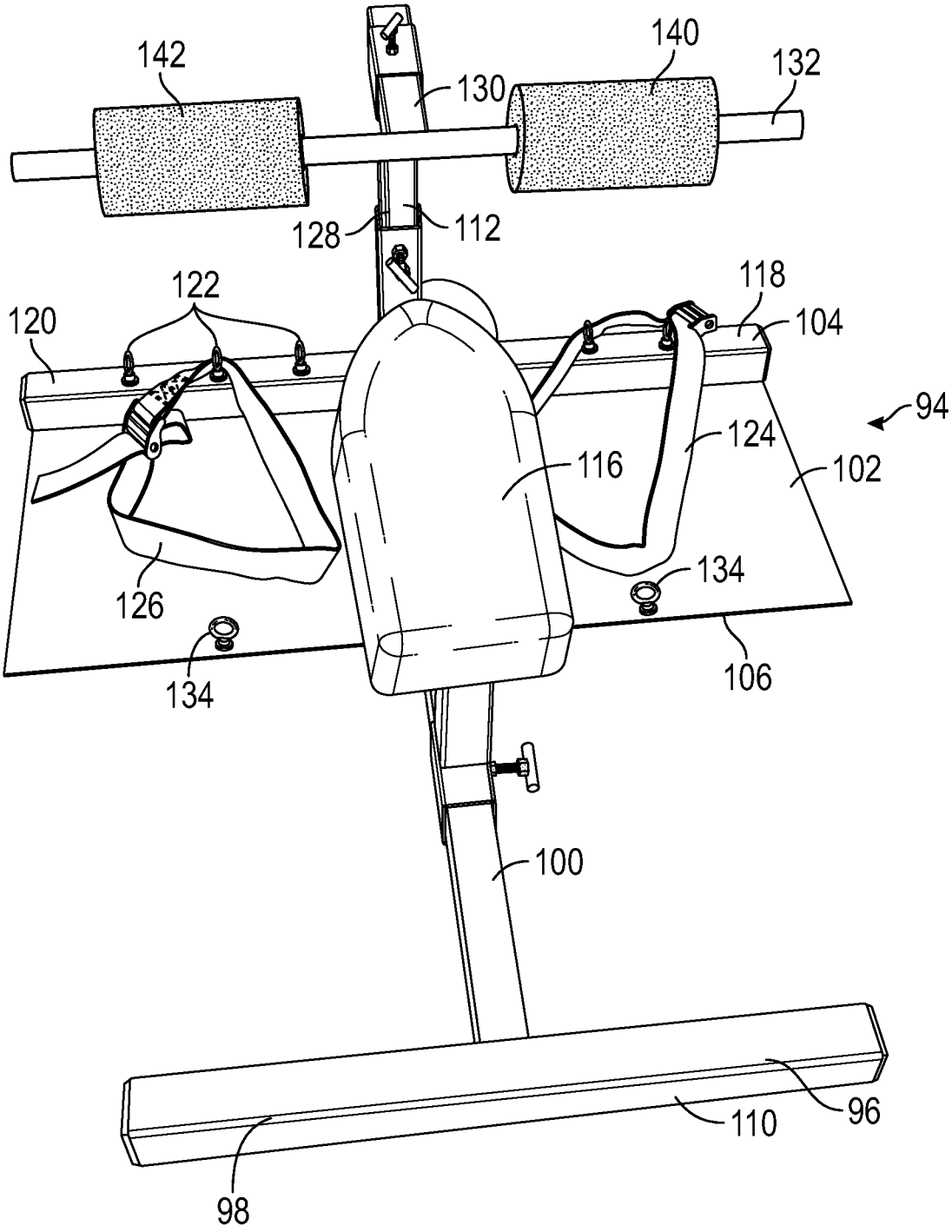
FIG. 7 is a top rear view of the squat machine of FIG. 5.
Figure 8:
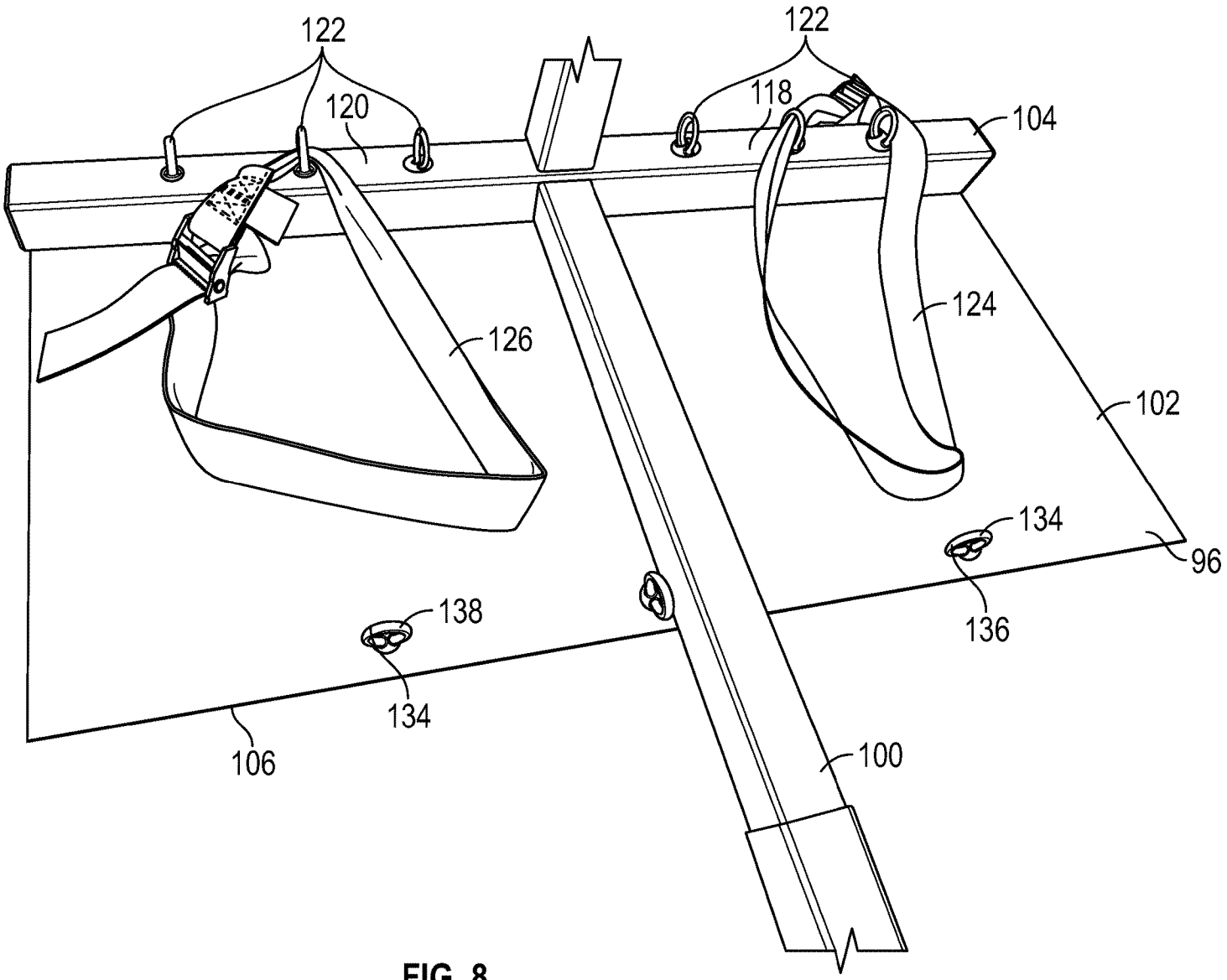
FIG. 8 is a top view of the platform of the squat machine of FIG. 5.

Referring to FIGS. 5-8, a second implementation of a squat machine is illustrated. More specifically, referring to FIG. 5, a perspective view of a second implementation of a squat machine is illustrated. Referring to FIG. 6, a front view of the squat machine of FIG. 5 is illustrated. Referring to FIG. 7, a top rear view of the squat machine of FIG. 5 is illustrated. Referring to FIG. 8, a top view of the platform of the squat machine of FIG. 5 is illustrated.

Any elements of the implementation of the squat machine of FIGS. 1-4 and 9 may be included in the squat machine of FIGS. 5-8. Likewise, any elements of the squat machine of FIGS. 5-8 may be included in the squat machine of FIGS. 1-4 and 9.

Referring to FIGS. 5-8, the squat machine includes a front 108 and a rear 110. The squat machine 94 includes a platform 96. The platform 96 may include a rear support 98, a central support 100, a deck 102, and a front support 104. The platform may be made from any material or combination of materials disclosed herein. In various implementations, the front support 104 may also be considered a front foot brace and a second foot brace coupled to the platform 96 rather than as part of the platform.

In various implementations, the deck 102 may be similar to the deck of FIGS. 1-4 inasmuch as it is configured to support a user while performing a squat exercise on the squat machine 94. In various implementations, the deck 102 of FIGS. 5-8 may differ from the deck of FIGS. 1-4 as the rear portion 106 of the deck only extends to a middle of the platform. In other implementations the deck 102 may be longer (or extend further towards the rear 110 of the squat machine 94) or shorter than what is illustrated by FIGS. 5-8.

The squat machine 94 may include a seat post 112 coupled to the central support 100. The seat post 94 may be slidably and/or adjustably coupled to the central support 100. In other implementations, the seat post 94 may be non-adjustably coupled to the central support 100. Other elements of the seat post 94 may be the same as or similar to any other elements of seat posts disclosed herein. In implementations having a telescoping seat post, the seat post may include a locking mechanism including a pin 114 configured to lock the height of the seat post at a particular position.

In various implementations, the squat machine 94 may include a seat 116. The seat 116 may be the same as or similar to any other seat disclosed herein.

In various implementations, the squat machine 94 may include a first foot brace 118 and a second foot brace 120. The foot braces may be the same as or similar to any other foot braces disclosed herein. In various implementations, the squat machine 94 may include a plurality of foot restraint attachment mechanisms 122 directly coupled to the first foot brace 118 and the second foot brace 120. In such implementations, the position of a first foot restraint 124 and the second foot restraint 126 may be adjusted as the first foot restraint may be attached to any of the foot restraint attachment mechanisms directly coupled to the first foot brace 118 and the second foot restraint may be coupled to any of the second foot restraint attachment mechanisms directly coupled to the second foot brace 120. In various implementations, each of the plurality of foot restraint attachment mechanisms 122 may include a ring.

In other implementations the squat machine may include a first foot restraint attachment mechanism adjustably coupled to the first foot brace and a second foot restraint attachment mechanism adjustably coupled to the second foot brace.

In various implementations, the squat machine includes a first foot restraint 124 and a second foot restraint 126. The first foot restraint 124 and the second foot restraint 126 may be the same as or similar to any other type of foot restraint disclosed herein. In particular implementations, the first foot restraint 124 and the second foot restraint 126 may each include a strap configured to wrap around either a user's calf or ankle. In various implementations, the first foot restraint 124 and the second foot restraint 126 may each include padded ankle cuffs.

Referring to FIGS. 5-7, the squat machine 94 may include a knee brace post 128, a knee brace arm 130, and a knee brace 132. The knee brace post 128, the knee brace arm 130, and the knee brace 132 may be the same as or similar to any other knee brace post, knee brace arm, or knee brace disclosed herein. The knee brace 132 may include a first knee brace pad 140 and a second knee brace pad 142. The first knee brace pad 140 and the second knee brace pad 142 may be adjustable. The knee brace pads may provide padding between the front of the user's knee or shin and the remainder of the knee brace 132 when performing a squat exercise on the squat machine.

Referring to FIGS. 5-8, the squat machine 94 may include one or more resistance attachment mechanisms 134. In various implementations, the squat machine 94 may include a first resistance attachment mechanism 136 and a second resistance attachment mechanism 138. In other implementations, the squat machine 94 may include more than two resistance attachment mechanisms. In various implementations, and as illustrated by FIGS. 5-8, the one or more resistance attachment mechanisms 134 may be non-adjustably coupled to the deck. In other implementations, the one or more resistance attachment mechanisms may be directly coupled to the central support 100, the rear support 98, any other part of the deck 102, or the seat 116. In other implementations, the one or more resistance attachment mechanisms 134 may be adjustably coupled to the deck, platform, and/or seat.

In various implementations, the squat machine 94 may include a belt or chest harness the same as or similar to any other belt or chest harness disclosed herein.

Figure 10:
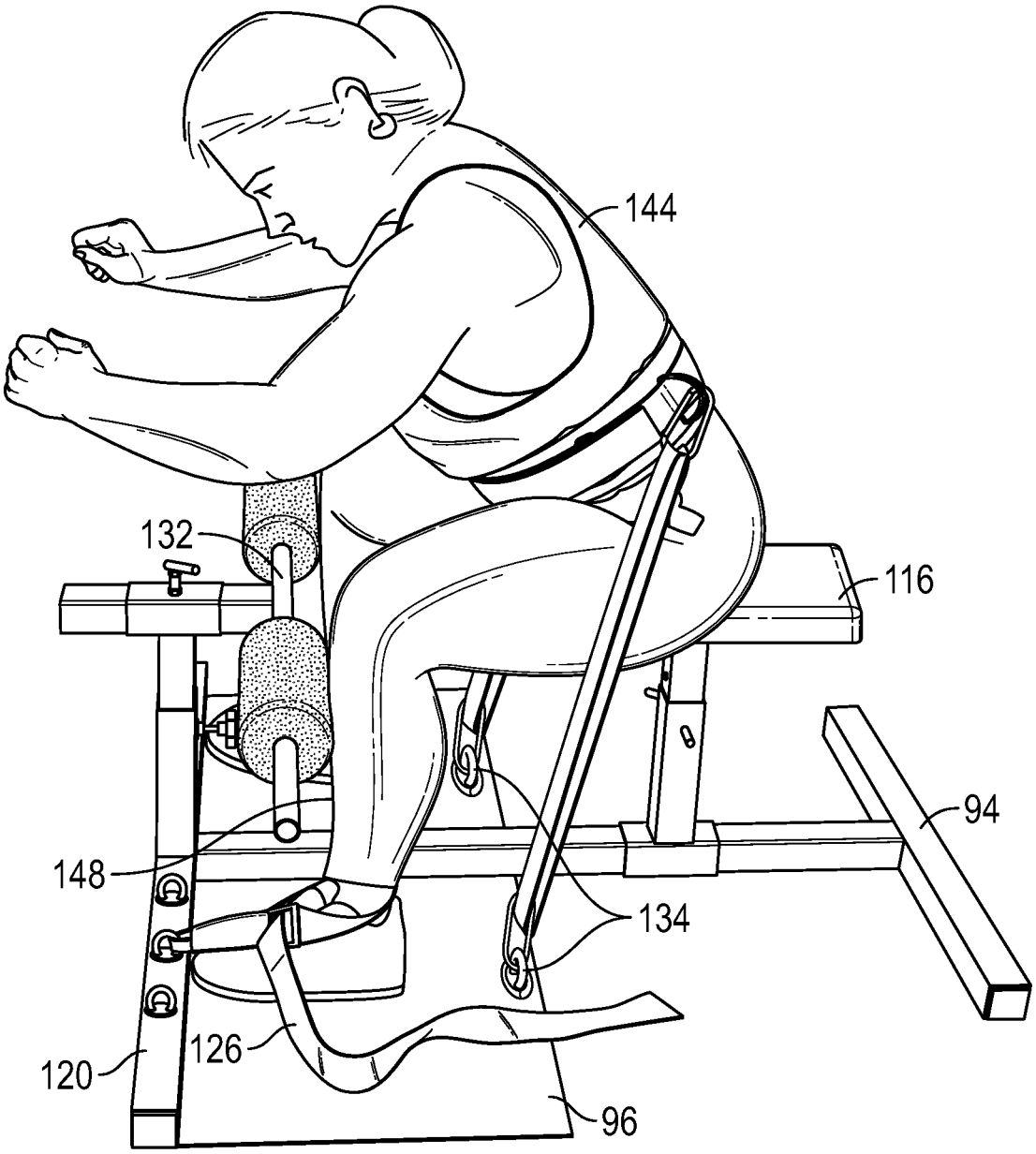
FIG. 10 is a view of an individual using the squat machine of FIG. 6 and in a squatting position.
Figure 11:
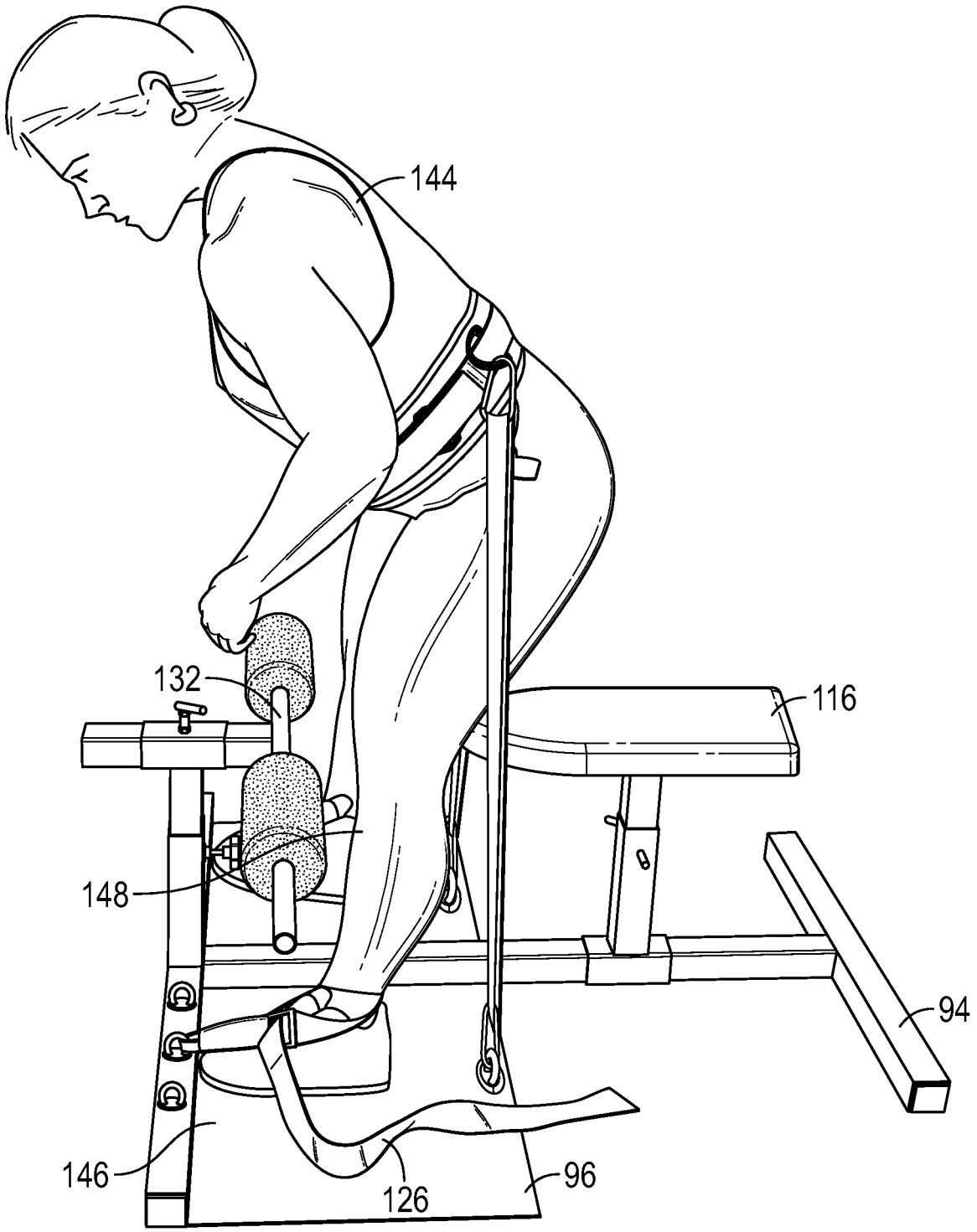
FIG. 11 is a view of an individual using the squat machine of FIG. 6 in a standing position.

Referring to FIG. 10, a view of a user using the squat machine of FIG. 6 and in a squat position is illustrated and referring to FIG. 11, a view of a user using the squat machine of FIG. 6 in a standing position is illustrated. As illustrated by FIG. 10, the user 144 may perform a squat exercise on the squat machine by sitting on the seat 116 and placing their feet upon the platform 96. The user 144 may align their feet with their hips and the front of the user's feet may be placed against the first foot brace 118 and the second foot brace 120. The user 144 may secure the first foot restraint and the second foot restraint around the user's ankles to secure the user's feet to the platform. As illustrated by FIG. 10, when the user is in a seated position the front of the user's knees or shins may contact the knee brace. In such implementations the squat machine is configured to keep the user's shins in a position substantially perpendicular to the platform when the user is in a squat position. Further, the user's knees are prevented from moving any further forward due to the knee brace.

In various implementations, the thighs of the user may be substantially parallel to the floor when the user is in a squatting position. In other implementations, the seat may be raised or lowered and result in the thighs of the user not being parallel to the floor.

In various implementations the user may couple one or more resistance bands to a belt 146 (or in other implementations, a chest harness) and to one or more resistance attachment mechanisms 134. In implementations having adjustable resistance attachment mechanisms, the user may be able to adjust the position of the resistance attachment mechanisms in order to better isolate or work particular muscles during the squat exercise. In other implementations, the squat exercise may be performed without any resistance bands.

To perform the squat exercise a user may move from the seated position of FIG. 10 to the standing position of FIG. 11. As illustrated by FIGS. 10-11, during the squat exercise the squat machine 94 is configured to keep an angle between a front of the user's shins 148 and a front portion 146 of the platform 96 at either 90 degrees or above 90 degrees through an entire motion of the squat exercise. In such implementations, this is possible due to the knee brace preventing forward movement of the user's knees and the foot restraints preventing rearward movement of the user's feet. In such implementations, the squat machine is configured to allow a user to perform a squat exercise where they go from a sitting to a standing position without the knees moving forward and over the front of the user's feet. In the implementations disclosed herein, by having the ankles and knees both locked into position, the initiation of movement from a traditional squat is altered to teach the body how start at the heels engaging the Calcaneal (Achilles) tendon, and working through the Plantaris muscle, Soleus, Gastrocnemius and the Plantaris and Posterior Cruciate Ligament (PCL) insertion behind the knee. In such implementations, this may force the Biceps Femoris, Adductor Magnus, Semitendinosus, Semimembranosus and the Iliotibial tract to engage, support and carry the Femoral bone around the knee and hip joint. This in turn engages the Gluteus Maximus directly to fire and support the *Piriformis* and strengthen it. In turn, this may also work the Iliacus Extensors, Psoas, Transverse Abdominal, and Quadratus Lumorum, which may all teach the body to use the Thoracic spine and engage the Intercostals and Serratus in order to hold the upper portion of the body while allowing the lower portion of the body to properly move around the joints of the ankles, knees and hips. In such implementations, the application of pressure in the wrong angles of the joints may be avoided and the tendons and ligaments may be trained to support the joints through the movement.

In implementations having weight resistance connected to a user at the center of their back (which resistance may be coupled to the user through a chest harness), the weight resistance may distribute the weight more centered through the Sacrum. In turn, this may allow for more side-to-side balance and proper initiation of movement. Contrary to this are traditional squats that may put undue pressure on top of the Clavicle or on the sides of a user which may stress the joints upon initiation of movement and causes unnecessary pressure, resulting in damage to the ankles, knees, and/or hips.

In places where the description above refers to particular implementations of squat machines and implementing components, sub-components, methods and sub-methods, it should be readily apparent that a number of modifications may be made without departing from the spirit thereof and that these implementations, implementing components, sub-components, methods and sub-methods may be applied to other squat machines.

What is claimed is:

1. A squat machine comprising:

a platform comprising a first track and a second track;

a seat coupled to the platform, wherein the platform is configured to have a user stand on a first surface thereof while performing a squat exercise;

a first foot brace directly coupled to the platform;

a first foot restraint coupled to the first foot brace;

a second foot brace directly coupled to the platform;

a second foot restraint coupled to the second foot brace;

a knee brace post coupled to and extending perpendicularly away from the first surface of the platform;

a knee brace arm directly coupled to the knee brace post and extending perpendicularly away from a longest length of the knee brace post;

a knee brace directly coupled to the knee brace arm, the knee brace configured to contact the front of one of a user's knees or shins while performing a squat exercise;

a first resistance attachment mechanism slidably coupled within the first track;

a second resistance attachment mechanism slidably coupled within the second track;

a belt configured to be worn by the user while performing the squat exercise; and a plurality of resistance bands configured to couple to the belt and to the first resistance attachment mechanism and the second resistance attachment mechanism;

wherein the seat is configured to temporarily contact a buttocks of a user while performing the squat exercise.

2. The squat machine of claim 1, wherein the first resistance attachment mechanism and the second attachment mechanism are configured to slide in a direction parallel to a longest length of the squat machine.

3. The squat machine of claim 2, further comprising:

a third track comprised in the platform;

a third resistance mechanism slidably coupled within the third track; and a fourth resistance mechanism slidably coupled within the third track;

wherein the third track is perpendicular to the first track and the second track.

4. The squat machine of claim 1, further comprising:

a third track comprised in the platform;

a fourth track comprised in the platform;

a third resistance attachment mechanism slidably coupled within the third track; and a fourth resistance attachment mechanism slidably coupled within the fourth track; wherein the third track and the fourth track are parallel to the first track and the second track.

5. The squat machine of claim 1, further comprising:

a seat post track comprised within a center of the platform, the seat post track extending parallel to a longest length of the squat machine; and a seat post slidably coupled within the seat post track and directly coupled to the seat.

6. The squat machine of claim 1, wherein the first foot brace comprises a first pillar extending perpendicularly away from the platform and wherein the second foot brace comprises a second pillar extending perpendicularly away from the platform.

7. The squat machine of claim 1, wherein a first distance parallel to the platform between the knee brace and a rear of the squat machine is less than a second distance parallel to the platform between the first foot brace and the rear of the squat machine.

8. The squat machine of claim 1, wherein the squat machine is configured to keep the user's shins in a position substantially perpendicular to the platform when the user is in a squat position.

9. The squat machine of claim 1, wherein the knee brace comprises a first knee brace pad and a second knee brace pad.

* * * * *